US010814158B2

(12) United States Patent
Mancias

(10) Patent No.: US 10,814,158 B2
(45) Date of Patent: Oct. 27, 2020

(54) WEIGHTLIFTING BENCH

(71) Applicant: Mancias Management Group, LLC, Key Biscayne, FL (US)

(72) Inventor: Michael Mancias, Hawthorne, CA (US)

(73) Assignee: Mancias Management Group, LLC, Key Biscayne, FL (US)

( * ) Notice: Subject to any disclaimer, the term of this patent is extended or adjusted under 35 U.S.C. 154(b) by 30 days.

(21) Appl. No.: 16/169,319

(22) Filed: Oct. 24, 2018

(65) Prior Publication Data

US 2019/0118028 A1 Apr. 25, 2019

Related U.S. Application Data

(60) Provisional application No. 62/576,138, filed on Oct. 24, 2017.

(51) Int. Cl.

| | |
|---|---|
| ***A63B 21/00*** | (2006.01) |
| ***A63B 21/078*** | (2006.01) |
| ***A63B 26/00*** | (2006.01) |
| ***A63B 23/02*** | (2006.01) |
| ***A63B 21/072*** | (2006.01) |
| ***A63B 22/16*** | (2006.01) |

(52) U.S. Cl.

CPC .... *A63B 21/4029* (2015.10); *A63B 21/00047* (2013.01); *A63B 21/078* (2013.01); *A63B 21/4033* (2015.10); *A63B 23/02* (2013.01); *A63B 26/003* (2013.01); *A63B 21/0724* (2013.01); *A63B 21/4039* (2015.10); *A63B 22/16* (2013.01); *A63B 2208/0252* (2013.01); *A63B 2209/00* (2013.01); *A63B 2225/09* (2013.01)

(58) Field of Classification Search

CPC ..... A63B 21/00; A63B 21/00047; A63B 21/0005; A63B 21/4029; A63B 26/003; A63B 21/4033; A63B 23/02; A63B 21/078; A63B 22/16; A63B 21/4036; A63B 2209/00; A63B 21/0724; A63B 2208/0252; A63B 2225/09

See application file for complete search history.

(56) References Cited

U.S. PATENT DOCUMENTS 4,319,747 A * 3/1982 Rogers ..... A63B 21/151 482/104

4,474,370 A 10/1984 Oman (Continued)

OTHER PUBLICATIONS

Precor Leg Curl Assembly Guide (Publication Date Oct. 31, 2014) https://www.precor.com/sites/default/files/manuals/DPL_LegCurl_Manuals_121614_EN_0.pdf (Year: 2014).*

(Continued)

*Primary Examiner* — Andrew S Lo

(74) *Attorney, Agent, or Firm* — Nick Guinn; Gunn, Lee & Cave, P.C.

(57) ABSTRACT

A weightlifting bench comprising two adjustable arms that translate across a pair of horizontal rails. The adjustable arms each attaching to a corresponding cushion holder. Each cushion holder containing a stiff, textured, round cushion intended to isolate and challenge the core musculature and strengthen core and back supportive structures to promote proper spine health and alignment.

32 Claims, 4 Drawing Sheets

(56) References Cited

U.S. PATENT DOCUMENTS 5,649,886 A * 7/1997 Danylieko ..... A63B 21/078 482/104
5,830,113 A * 11/1998 Coody ..... A63B 22/02 482/54
6,565,495 B2 5/2003 Slattery
7,534,200 B1 * 5/2009 Martinez ..... A63B 21/00047 482/142
8,568,281 B2 10/2013 Beaulieu
9,504,870 B2 11/2016 Crawley
2003/0220176 A1 * 11/2003 O'Connor ..... A63B 21/078 482/142
2005/0124922 A1 * 6/2005 Lin ..... A47C 7/14 601/115
2006/0035772 A1 * 2/2006 Golesh ..... A63B 21/4031 482/142
2007/0225135 A1 * 9/2007 Webber ..... A63B 23/02 482/140
2008/0318745 A1 * 12/2008 Forcillo ..... A63B 21/4047 482/145
2009/0305856 A1 * 12/2009 Pandozy ..... A63B 21/4029 482/140
2011/0034839 A1 * 2/2011 Yang ..... A63B 21/4031 601/128
2011/0039665 A1 * 2/2011 Dibble ..... A63B 21/4031 482/92
2011/0245047 A1 * 10/2011 Dellino ..... A63B 21/0615 482/97
2012/0065557 A1 * 3/2012 Phillips ..... A61H 15/0092 601/99
2015/0246259 A1 9/2015 Stoesslein
2017/0296867 A1 * 10/2017 Doane ..... A61H 1/008
2018/0369633 A1 * 12/2018 Baker ..... A63B 21/4029

OTHER PUBLICATIONS

Precor Leg Curl Date https://www.precor.com/sites/default/files/manuals/DPL_LegCurl_Manuals_121614_EN_0.pdf (Year: 2014).*
http:///www.vicorefitness.com/core-bench.
http://www.vicorefitness.com/0-90-bench.

* cited by examiner

WEIGHTLIFTING BENCH

CROSS REFERENCES TO RELATED APPLICATION

This application claims the benefit of and priority to U.S. Provisional Application Ser. No. 62/576,138, filed Oct. 24, 2017 and entitled Weightlifting Bench, which is incorporated by reference herein.

FEDERALLY SPONSORED RESEARCH OR DEVELOPMENT

Not applicable.

BACKGROUND OF THE INVENTION

1. Field of the Invention

The present invention relates to the field of devices used to assist weightlifters in performing weightlifting exercises and more specifically to adjustable bench presses designed to strengthen the core while engaging intrinsic musculature and supportive structures.

2. Description of the Related Art

Weightlifting is a popular activity that provides numerous health benefits. Weightlifting improves body composition and gives a toned appearance. It can also improve overall health and make for a happier person. Weightlifting helps burn fat, reduces the risk of diabetes, prevents back pain and helps fight depression. One of the most popular weightlifting exercises is the bench press, which involves a participant resting with their back on a bench—feet on the floor—and lifting one or more weight(s) away from to his/her body. The bench press exercise works the pectoralis major as well as supporting chest, arm, and shoulder muscles such as the anterior deltoids, serratus anterior, coracobrachialis, scapulae fixers, trapezii, and the triceps.

Variations on the bench press can be performed using different types of weights and benches, as well as different movements of the arms. Two popular variations are the incline- and decline-bench press. Rather than resting on a bench that is parallel to the floor, the participant rests on an inclined or declined bench, respectively. Performing one or more repetitions on an incline bench elevates the shoulders and lowers the pelvis, thereby emphasizing the anterior deltoids with little emphasis at the upper (clavicular) head of the pectoralis major. Performing one or more repetitions on a decline bench, however, elevates the pelvis and lowers the shoulders, and emphasizes the lower portion of the pectoralis major. Benches are typically fixed in their incline, decline or parallel orientation.

Regardless of whether the bench is parallel with the floor, inclined, or declined, most if not all weightlifting benches are wide and flat. Problems and limitations arise. For instance, less emphasis is placed on the participant's core (e.g., back and abdominal muscles) when performing repetitions. Additionally, the participant's range of motion is further limited due to the width of the bench.

Some weightlifting benches include footrests for the participant to use. Unfortunately, most of these footrests are fixed and cannot be adjusted. This creates problems for participants of different heights or wishing to perform different exercises.

The present invention corrects the problems identified above. First, the present invention allows the user to adjust the orientation of the bench (and the seat) from incline, to parallel to decline (and at varying degrees). Second, the present invention allows the participant to replace the cushion and selection different options based on stiffness, curvature/flatness, width, texture, etc. Third, the present invention allows the participant to adjust the vertical and horizontal placement of the footrest or remove the footrest altogether. Fourth, the present invention allows the participant to adjust the vertical and horizontal placement of the cushions (i.e., roller).

BRIEF SUMMARY OF THE INVENTION

A weightlifting bench comprising two gliding rails along with a footrest; vertical plates connected to the two gliding rails; two adjusting arms each connected at their distal ends to the two gliding rails and connected at their proximal ends to two respective roller holders; each roller holder containing a roller.

DETAILED DESCRIPTION OF THE INVENTION

Figure 1:
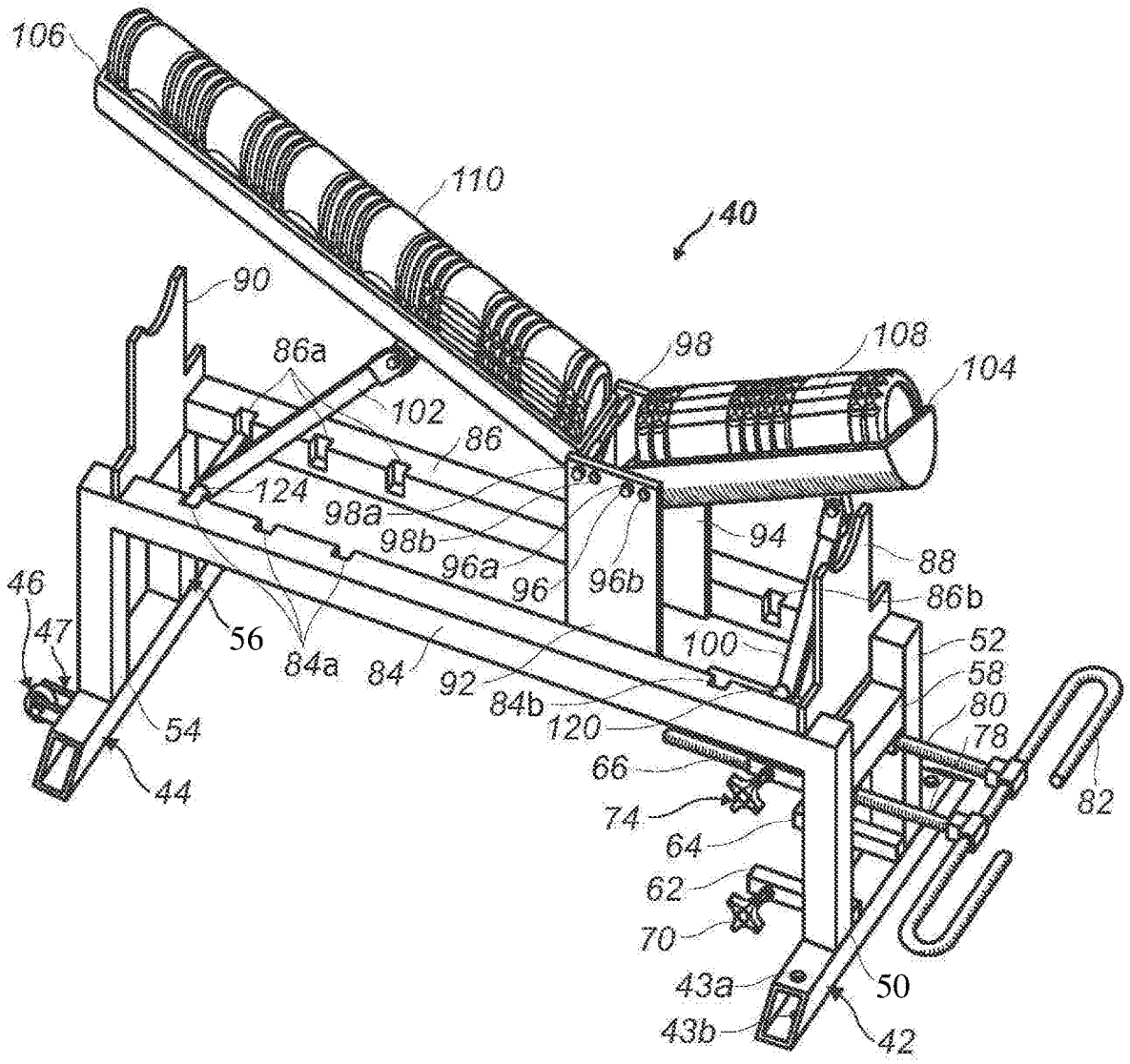
FIG. 1 shows a perspective view of the bench.

FIG. 1 shows a perspective view of one embodiment of the weightlifting bench 40 herein referred to as the bench 40. The bench 40 includes a hollow, front floor rail 42—which consists of at least holes 43*a* and 43*b*—and a rear floor rail 44. The front floor rail 42 and the rear floor rail 44 make contact with the ground and provide stability for the bench 40. Holes 43*a*, 43*b* can receive a bolt to secure the bench 40 to the ground or other surface.

A pair of wheels 46 are connected to the rear floor rail 44 by plates 47 extending from the rear floor rail 44 and holding the wheels with axles (not numbered). In this embodiment the wheels 46 are included such that someone using the bench 40 can easily move the bench 40 around a gym/room or otherwise transport the bench 40 without needing to lift the bench 40 entirely off the ground. Although not illustrated in the drawings, additional wheels could be added to the front floor rail 42.

Like most weightlifting benches, the bench 40 is configured such that the user is elevated off the ground. In this embodiment, the bench is elevated via four vertical rails 50, 52, 54, 56 in two pairs; each pair connected to one of the floor rails 42, 44. A front elevated rail 58 connects to vertical rails 50, 52. A rear elevated rail 60 (shown in FIG. 2) connects to vertical rails 54, 56. The elevated rails add stability to the bench 40 and add to the securement of the securement rails 62, 64, 66, 68 (securement rail 68 not shown).

The four securement rails 62, 64, 66, 68 are positioned on the interior corners resulting from the connections between the vertical rails 50, 52 and the front floor rail 42 and front elevated rail 58. Positioned exterior and perpendicular to each of the four securement rails 62, 64, 66, 68 are securement rail fasteners 70, 72, 74, 76 (fasteners 72, 76 not shown). The securement rail fasteners 70, 72, 74, 76 are threaded and used to tighten and secure footrest arms 78, 80.

The four securement rails 62, 64, 66, 68 are sufficiently hollow/spacious to hold sliding footrest arms 78, 80 in place. At the end of the footrest arms 78, 80 is the footrest 82. The participant can loosen/tighten the securement rail fasteners 70, 72, 74, 76 to increase or decrease the distance between the footrest 82 and the rest of the bench 40. The desired distance will likely depend on the height of the participant as well as the intended exercise to be performed by the participant. The participant can also adjust the vertical placement of the footrest 82 by moving the footrest arms 78, 80 between the lower pair of securement rails 62, 64 and the upper pair of securement rails 66, 68. Adjustment of the footrest and vertical location of the bench allows a better fit to different size (heights, weights, etc.) athletes and other users. It can also allow the user to increase/decrease the amount of effort placed on the corse/torso versus the legs.

The bench 40 further comprises a pair of gliding rails 84, 86 that each connect to the vertical rails. The gliding rails 84, 86 are generally parallel with the floor or ground surface and their length is on the magnitude of a person's height. Additionally, the gliding rails 84, 86 include several grooves 84*a*, 84*b*, 86*a*, 86*b*—the purpose of which is described herein below.

The embodiment illustrated herein contains a front vertical plate 88 and a rear vertical plate 90, which are parallel to one another and each connect to both of the gliding rails 84, 86. In this embodiment, the vertical plates 88, 90 have semi-circular cutouts along each of their respective top edges. The vertical plates 88, 90 when engaged can add further stability to the first roller and second roller (or first roller holder and second roller holder) when used in certain positions (the rollers and the roller holders are discussed in greater detail below).

The bench further comprises a first middle vertical plate 92 a second middle vertical plate 94. The first middle vertical plate 92 connects to the left gliding rail 84 and is parallel to the second middle vertical plate 94, which connects to the right gliding rail 86. The two middle vertical plates are oriented perpendicularly to the front and rear vertical plates 88, 90. Two rods 96, 98 each connect to the first and second middle vertical plates 92, 94 at rod holes 96*a*, 96*b*, 98*a*, 98*b*. In this embodiment, rod 96 can rest in rod holes 96*a* or in rod holes 96*b* for horizontal (i.e., lateral) adjustment of the first roller (or first roller holder) further discussed below. In this embodiment, rod 98 can rest in rod holes 98*a* or in rod holes 98*b* for horizontal (i.e., lateral) adjustment of the second roller (or second roller holder).

The middle vertical plates raise the roller holders and accordingly elevate the participant above the floor or ground surface more than any other weightlifting bench known in the prior art. Elevating the participant in this manner promotes increased Central Nervous System and Proprioception Strength and Awareness.

The bench 40 further comprises a front adjusting arm 100 and a rear adjusting arm 102. The adjusting arms 100, 102 each connect to the two gliding rails 84, 86 at their distal ends and to one of two roller holders 104, 106 at their proximal ends. In this embodiment, the adjusting arms 100, 102 connect to the gliding rails 84, 86 at the several grooves 84*a*, 84*b*, 86*a*, 86*b*. A first axle 120 attaches to the distal end of the adjusting arm 100 and may be secured (and adjusted between) to one or more of the pairs of the several grooves 84*a*, 84*b*, 86*a*, 86*b*. Similarly, a second axle 124 attaches to the distal end of the adjusting arm 102 and may be secured (and adjusted between) one or more of the pairs of the several grooves 84*a*, 84*b*, 86*a*, 86*b*. Adjusting the first axle 120 and/or second axle 124 between one or more of the pairs of the several grooves 84*a*, 84*b*, 86*a*, 86*b* allows the user to adjust the height and angle of the first roller and/or second roller (and/or the first roller holder and/or second roller holder).

In the illustrated embodiment, the two roller holders 104, 106 are rounded and each contain a roller 108, 110. In this embodiment, the rollers 108, 110 are stiff, textured, and rounded. In weightlifting, the combination of one or more of these attributes allows for isolation of certain muscles, strengthens the core by engaging intrinsic musculature and supportive structures, and provides other benefits to a participant. In particular, it facilitates self-myofascial release—applying pressure to specific points on the body to aid in the recovery of muscles and assist in returning them to normal function (i.e., muscles that are elastic, healthy, and ready to perform at a moment's notice).

The rollers can be constructed from several materials, including rubber, foam, ethylene-vinyl acetate, high density foam, closed cell foam, etc. Typical weightlifting benches are made from giving and absorbing materials. It is anticipated in several embodiments of the present invention that the rollers will be constructed from a firmer material that facilitates self-myofascial release.

Figure 4:
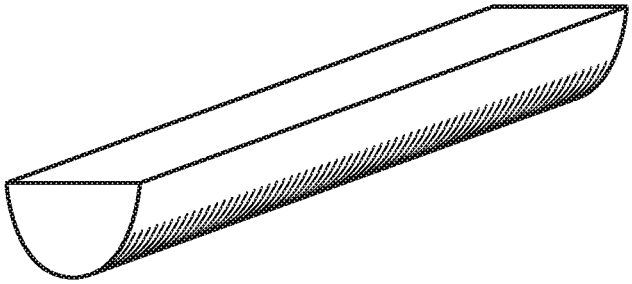
FIGS. 4-6 show alternative embodiments of a roller for use with the bench shown in FIGS. 1-3.
Figure 5:
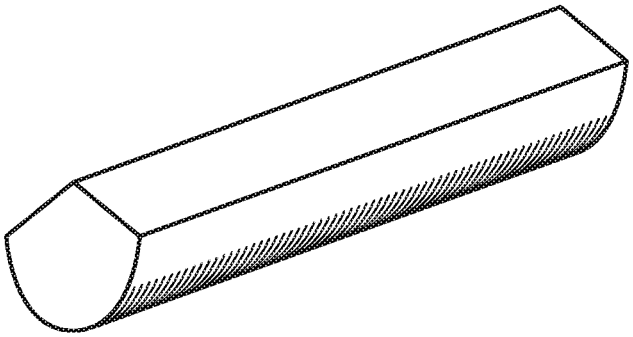
Figure 6:
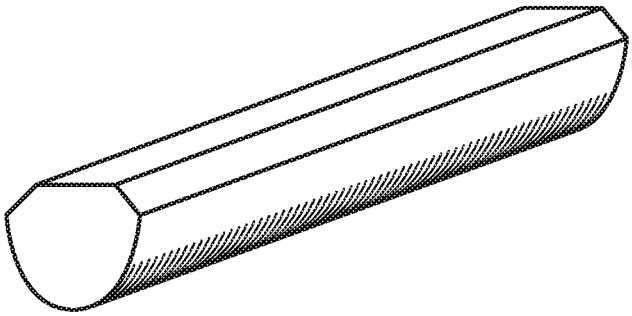

The rollers can be constructed in a variety of shapes. The illustrated embodiment shows rollers of a generally cylindrical shape with various surface texture/patterns available (and discussed below). Shapes, might include: circles, ovals, ellipses, parabolas, hyperbolas, crescents, curvilinear triangles, quatrefoils, parallelograms, squares, rectangles, trapezoids, trapeziums, triangles, kites, rhombus, pentagons, hexagons, heptagons, octagons, nonagons, decagons, etc. Other shapes might include channels or H-shapes (such as the Myo-Roller by PowerSystems). Additionally, multiple shapes might be incorporated into different segments of the roller (i.e., head/neck versus lumbar or exposed half versus lower half, etc.). FIGS. 4-6 illustrate such various embodiments. Such variations might be appropriate to accommodate the shape of a fixed roller holder such as the generally rounded roller holders of FIGS. 1-3. The roller illustrated in FIG. 4, for instance, might be used as a replacement to the roller of FIGS. 1-3 in order to replicate the surface shape of more familiar weight lifting bench cushions (i.e., flat).

Figure 2:
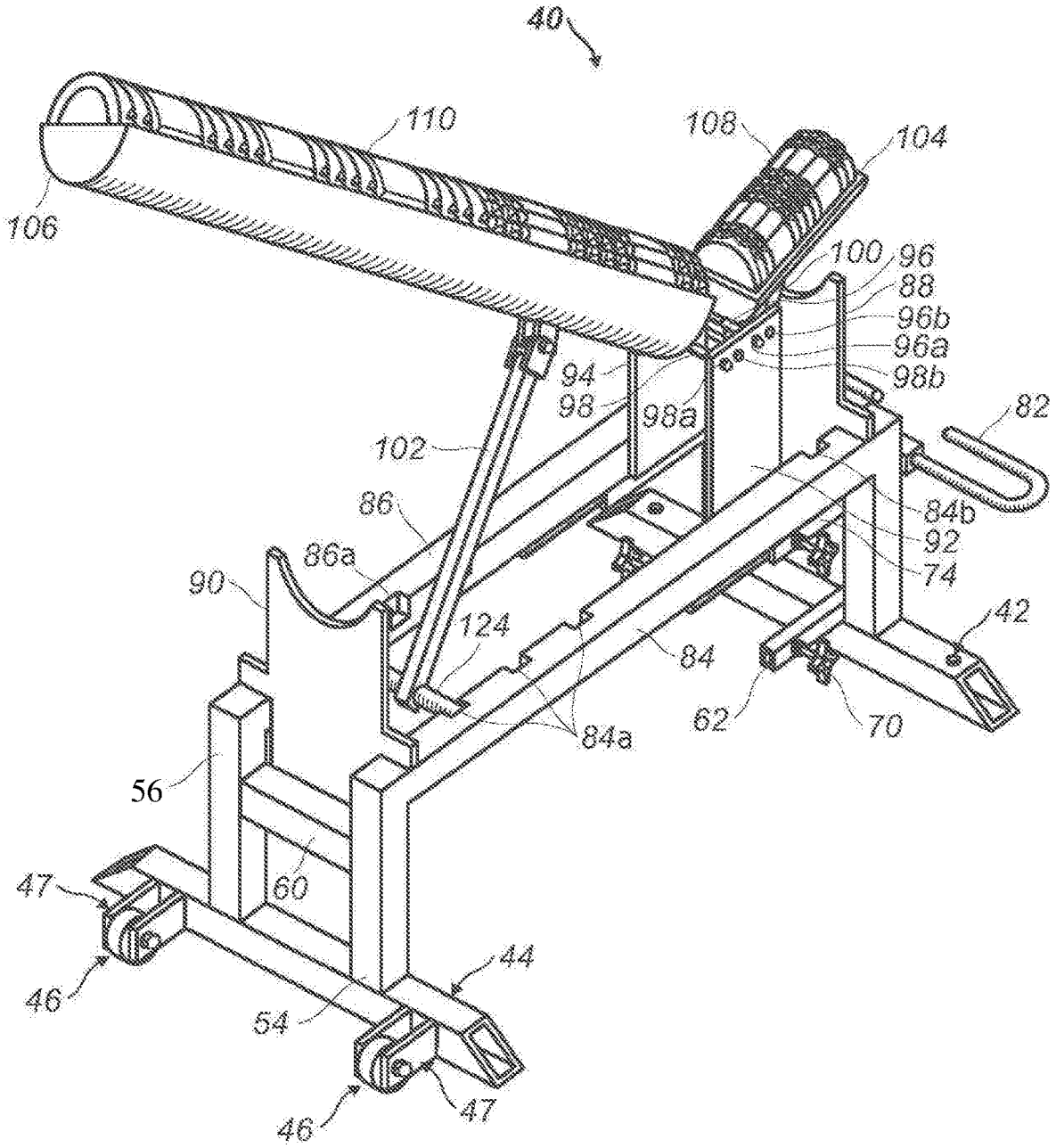
FIG. 2 shows an alternative perspective view of the bench shown in FIG. 1.
Figure 3:
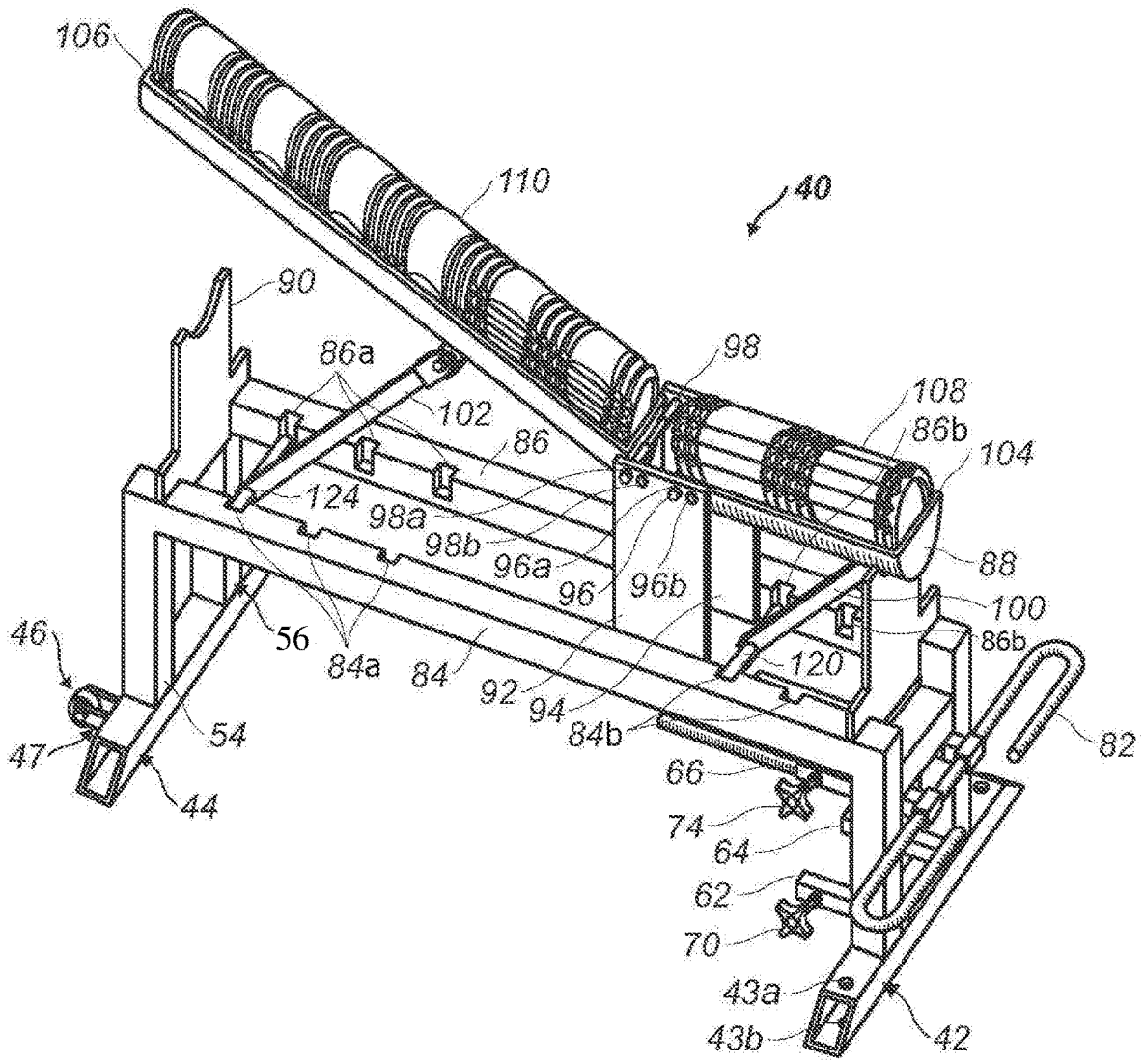
FIG. 3 shows an alternative perspective view of the bench shown in FIGS. 1 and 2.

The roller illustrated in FIG. 5 by contrast would similarly fit the generally rounded roller holders of FIGS. 1-3 but expose a more triangular shape.

The roller illustrated in FIG. 6 by contrast would similarly fit the generally rounded roller holders of FIGS. 1-3 but expose a more hexagonal shape. One of ordinary skill in the art will appreciate the embodiments of FIGS. 4-6 (and accordingly FIGS. 1-3) as not limiting. The shape of the roller holders could vary, as well (rectangular, triangular, etc.) and accommodate rollers of different shapes, as well.

In addition to the variety of shapes that might be used in alternative embodiments, the rollers could embody a variety of alternative patterns/textures. Such patterns or textures might assist the user at different trigger points or provide a different exercise experience. One of ordinary skill in the art will appreciate the variety of alternative patterns and textures, including but not limited to tactile grids, ribs, beads, protrusions (such as the RumbleRoller by PowerSystems), and other generally unsmooth surfaces (collectively forming the group of "surface protrusions") or smooth. Additionally, multiple patterns and textures might be incorporated different segments of the roller (i.e., head/neck versus lumbar) or exposed half versus lower half, etc.

Although not limiting, the rollers of the illustrated embodiment have a diameter of six inches. One of ordinary skill will appreciate that the rollers could exist in different dimensions and sizes.

FIGS. 2 and 3 illustrate alternative views of the embodiment of the invention shown in FIG. 1.

While the invention has been shown and described with reference to a particular embodiment thereof, it will be understood to those skilled in the art, that various changes in form and details may be made therein without departing from the spirit and scope of the invention. Other aspects, features, and advantages of the present invention may be obtained from a study of this disclosure and the drawings, along with the appended claims.

In certain embodiments the front floor rail 42 and/or the rear floor rail 44 might include means for securing the bench 40 to the floor or other surface (e.g., bolts or other hardware). The illustrated embodiment shows holes 43*a*, 43*b*. The front floor rail 42 and/or the rear floor rail 44 might include additional or alternative holes. And in some embodiments the front floor rail and rear floor rail might not be hollow.

In certain embodiments the front floor rail 42 and/or the rear floor rail 44 might include orifices or other means for attaching auxiliary devices or attachments to the bench 40 (e.g., support arms for a barbell, kneepads).

In certain embodiments, the bench might not comprise floor rails and/or vertical rails. The weightlifting bench might be positioned closer to the floor or ground surface.

In alternative embodiments the securement rails could be modified or replaced for increased vertical variability of the footrest. For instance, the four securement rails could be replaced with two vertical rails that allow the participant to continuously slide the footrest arms up/down. In further embodiments, the securement rails and/or footrest arms could be configured for more discrete (rather than continuous) connectivity/securement. In further embodiments, the securement rails and footrest arms could exist in more or less than a pair (e.g., one arm and one securement rail; three arms and three securement rails, etc.).

In other embodiments, a different footrest could be used. For instance, the footrest might be rotatable in one or more axes. The footrest might consist of separate left and right foot pieces. In alternative embodiments, the footrest might be angled or incorporate alternative geometric shapes.

As an alternative to the gliding rails having a series of grooves or indentations, the gliding rails might be at least partially hollow on one of their respective faces, the faces oriented internally, or toward one another. In such an embodiment, the first axle and second axle might glide or slide more freely—and with locking mechanisms in certain further embodiments—in order to adjust the angle and vertical position of the first roller and second roller.

In certain embodiments the vertical plates might be of more disparate heights to allow for greater variability in the incline/decline of the bench. Certain embodiments might comprise more or less vertical planes (e.g., 1, 3, 0). Certain embodiments will have vertical planes that are adjustable or interchangeable. Such embodiments will make it even easier to adjust the vertical position of the first roller and second roller (or first roller holder and second roller holder).

In alternative embodiments, the middle vertical plate(s) might consist of more or less rod holes in order to provide for more or less combinations of rod-to-rod hole configurations (and accordingly position of the rollers or roller holders). Additionally, the rod holes could be located at different vertical positions in order to provide for adjustability of the vertical position of the rollers (or roller holders) either together or in relation to one another.

In an alternative embodiment the roller holders 104, 106 might each comprise railing on their undersides to allow for the adjusting arms 100, 102, respectively to glide freely along such railing. Such adjustment could allow the participant to adjust the height/angle of the roller holders 104, 106.

In an alternative embodiment the adjusting arms might attach directly to the rollers without the need for roller holders. Alternatively, the rollers might attach to the adjusting arms by way of a bracket or connecting plate in lieu of roller holders.

In further alternative embodiments the device might not include adjusting arms. Rather, the roller(s) and/or the roller holder(s) might connect directly to the gliding rails or other parts of the frame.

Various embodiments of the present invention may include one or more of the features and functions described above. One example embodiment includes all the features and functions described above.

In several embodiments of the present invention, the user's scapula will remain fairly retracted—when using the embodied device. Anterior translation of the scapula(s) when locking out the shoulders—which is common in the bench press and similar exercises—will frequently lead to less lateral stability than normal when performing the bench press (or similar exercises) or less stability than at the user's feet and legs. When the user experiences less lateral stability, he/she will be forced to squeeze/hug the bench even more with the scapula to provide stability from tipping sideways. This could also be countered by the legs. And in certain embodiments, the position or non-existence of the leg rest might provide even less stability and challenge the scapula further.

These and other objects, features, and advantages of embodiments of the invention will be apparent to those skilled in the art from the foregoing detailed description of embodiments of the invention, when read with the drawings and appended claims. It is to be understood that even though numerous characteristics and advantages of embodiments of the present invention have been set forth in the foregoing description, together with details of the structure and function of embodiments of the invention, this disclosure is illustrative only. Changes may be made in detail, especially matters of structure and management of parts within the principles of the present invention to the full extent indicated by the broad general meaning of the terms in which the appended claims are expressed.

Having disclosed exemplary embodiments and the best mode, modifications and variations may be made to the disclosed embodiments while remaining within the scope of the invention as defined by the following claims.

I claim:

1. A weightlifting bench comprising:

a frame;

a first cylindrical roller connected to the frame;

a second cylindrical roller connected to the frame;

the first roller or the second roller being a backrest and the other roller being a seat; and the roller being a backrest having a length that is longer than the roller being a seat.

2. The weightlifting bench of claim 1 wherein the first roller comprises at least one surface protrusion and at least one rib.

3. The weightlifting bench of claim 2 wherein the second roller comprises at least one surface protrusion and at least one rib.

4. The weightlifting bench of claim 1 wherein the first roller is removably positioned within a first roller container, the first roller container connected to the frame, and the second roller is removably positioned within a second roller container, the second roller container connected to the frame.

5. The weightlifting bench of claim 1 further comprising a footrest, the footrest slidably connected to the frame by at least a first footrest arm and a second footrest arm.

6. The weightlifting bench of claim 5 further comprising:

a hollow first upper securement rail having an interior dimension;

a hollow first lower securement rail having an interior dimension;

a hollow second upper securement rail having an interior dimension;

a hollow second lower securement rail having an interior dimension;

the first footrest arm having an outer dimension;

the second footrest arm having an outer dimension;

the outer dimension of the first footrest arm being smaller than the interior dimension of the first upper securement rail and the interior dimension of the first lower securement rail; and the outer dimension of the second footrest arm being smaller than the interior dimension of the second upper securement rail and the interior dimension of the second lower securement rail.

7. The weightlifting bench of claim 1 further comprising at least one vertical plate separating the frame and the first roller, the at least one vertical plate further separating the frame and the second roller.

8. The weightlifting bench of claim 7 wherein the first roller is pivotally connected to the at least one vertical plate.

9. The weightlifting bench of claim 8 wherein the second roller is pivotally connected to the at least one vertical plate.

10. The weightlifting bench of claim 1 further comprising a first pivoting arm and a second pivoting arm, the first roller connected to the first pivoting arm at a proximal end of the first pivoting arm, the frame connected to the first pivoting arm at a distal end of the first pivoting arm, the second roller connected to the second pivoting arm at a proximal end of the second pivoting arm, the frame connected to the second pivoting arm at a distal end of the second pivoting arm.

11. The weightlifting bench of claim 1 further comprising a first pivoting arm having a fixed length, the first roller connected to the first pivoting arm at a proximal end of the first pivoting arm, the frame connected to the first pivoting arm at a distal end of the first pivoting arm.

12. The weightlifting bench of claim 1 further comprising:

a first pivoting arm;

the first roller connected to the first pivoting arm at a proximal end of the first pivoting arm;

the frame having a plurality of pairs of grooves; and a distal end of the first pivoting arm removably connected to the frame at one of the pairs of grooves.

13. The weightlifting bench of claim 1 wherein the first roller is pitch rotationally connected to the frame.

14. The weightlifting bench of claim 1 wherein the first roller and second roller are the only rollers.

15. A weightlifting bench comprising:

a frame;

a first roller connected to the frame, the first roller having curvature between 90 degrees and 360 degrees;

a second roller connected to the frame, the second roller having curvature between 90 degrees and 360 degrees; the first roller or the second roller being a backrest and the other roller being a seat; and the first roller is removably positioned within a first roller container, the first roller container connected to the frame, and the second roller is removably positioned within a second roller container, the second roller container connected to the frame.

16. The weightlifting bench of claim 15 wherein the roller being a backrest having a length that is longer than the roller being a seat.

17. The weightlifting bench of claim 15 wherein the first roller comprises at least one surface protrusion and at least one rib.

18. The weightlifting bench of claim 15 further comprising at least one vertical plate separating the frame and the first roller, the at least one vertical plate further separating the frame and the second roller.

19. The weightlifting bench of claim 18 wherein the first roller is pivotally connected to the at least one vertical plate.

20. The weightlifting bench of claim 19 wherein the second roller is pivotally connected to the at least one vertical plate.

21. The weightlifting bench of claim 15 wherein the first roller is pitch rotationally connected to the frame.

22. The weightlifting bench of claim 15 wherein the first roller and second roller are the only rollers.

23. A weightlifting bench comprising:

a frame;

a first cylindrical roller connected to the frame, the first roller having a first base and a second base;

a second cylindrical roller connected to the frame, the second roller having a first base and a second base;

the first base of the first roller facing the first base of the second roller; and the first roller or the second roller being a backrest and the other roller being a seat.

24. The weightlifting bench of claim 23 wherein the first roller and second roller are the only rollers.

25. The weightlifting bench of claim 23 wherein the roller being a backrest having a length that is longer than the roller being a seat.

26. The weightlifting bench of claim 23 wherein the first roller is removably positioned within a first roller container, the first roller container connected to the frame, and the second roller is removably positioned within a second roller container, the second roller container connected to the frame.

27. The weightlifting bench of claim 23 wherein the first roller comprises at least one surface protrusion and at least one rib.

28. The weightlifting bench of claim 23 further comprising at least one vertical plate separating the frame and the first roller, the at least one vertical plate further separating the frame and the second roller.

29. The weightlifting bench of claim 28 wherein the first roller is pivotally connected to the at least one vertical plate.

30. The weightlifting bench of claim 29 wherein the second roller is pivotally connected to the at least one vertical plate.

31. The weightlifting bench of claim 23 wherein the first roller is pitch rotationally connected to the frame.

32. A weightlifting bench comprising:

a front floor rail;

a rear floor rail;

a first vertical rail connected to the front floor rail;

a second vertical rail connected to the front floor rail;

a third vertical rail connected to the rear floor rail;

a fourth vertical rail connected to the rear floor rail;

a front elevated rail connected to the first vertical rail and the second vertical rail;

a rear elevated rail connected to the third vertical rail and the fourth vertical rail;

a hollow first lower securement rail connected to the front floor rail and the first vertical rail;

a hollow first elevated securement rail connected to the front elevated rail and the first vertical rail;

a first lower securement rail fastener connected perpendicularly to the first lower securement rail;

a first elevated securement rail fastener connected perpendicularly to the first elevated securement rail;

a left footrest arm that is narrower in diameter than the first elevated securement rail, the left footrest arm removably connected to the first elevated securement rail;

a footrest connected to the left footrest arm;

a left gliding rail connected to the first vertical rail and the third vertical rail;

a right gliding rail connected to the second vertical rail and the fourth vertical rail;

a first plurality of grooves located along the left gliding rail;

a second plurality of grooves located along the right gliding rail, the second plurality of grooves opposite the first plurality of grooves;

a third plurality of grooves located along the left gliding rail;

a fourth plurality of grooves located along the right gliding rail, the fourth plurality of grooves opposite the third plurality of grooves;

a first middle vertical plate connected to the left gliding rail in between a front vertical plate and a rear vertical plate;

a second middle vertical plate connected to the right gliding rail in between the front vertical plate and the rear vertical plate;

a front rod connected to the first middle vertical plate and the second middle vertical plate;

a rear rod connected to the first middle vertical plate and the second middle vertical plate;

a front cushion holder connected to the front rod;

a rear cushion holder connected to the rear rod;

a rounded front cushion contained in the front cushion holder;

a rounded rear cushion contained in the rear cushion holder;

a front adjusting arm having a proximal end and a distal end, the front adjusting arm connected to the front cushion holder at the proximal end of the front adjusting arm, a front axle connected to the distal end of the front adjusting arm, the front axle perpendicular and adjustably connected to the first plurality of grooves and the second plurality of grooves; and a rear adjusting arm having a proximal end and a distal end, the rear adjusting arm connected to the rear cushion holder at the proximal end of the rear adjusting arm, a rear axle connected to the distal end of the rear adjusting arm, the rear axle perpendicular and adjustably connected to the third plurality of grooves and the fourth plurality of grooves.

* * * * *